US005997668A

United States Patent [19]

Aubert et al.

[11] Patent Number: 5,997,668

[45] Date of Patent: Dec. 7, 1999

[54] CASTABLE TNAZ/NITROAROMATICAMINE COMPOSITE EXPLOSIVE

[75] Inventors: Stephen A. Aubert; Robert L. McKenney, Jr., both of Niceville; Richard F. Reich, Ft. Walton Beach; Charles T. Sprague, Niceville, all of Fla.

[73] Assignee: The United States of America as represented by the Secretary of the Air Force, Washington, D.C.

[21] Appl. No.: 09/128,978

[22] Filed: Jul. 27, 1998

[51] Int. Cl.[6] ..... C06B 25/34; D03D 23/00

[52] U.S. Cl. ..... 149/92; 149/109.6

[58] Field of Search ..... 149/92, 109.6, 149/18; 264/3.1

[56] References Cited

U.S. PATENT DOCUMENTS 5,336,784 8/1994 Hiskey et al. .

5,467,714 11/1995 Lund et al. ..... 102/284

5,476,951 12/1995 Dave et al. .

5,529,649 6/1996 Lund et al. ..... 149/19.3

5,580,988 12/1996 Dave .

5,690,868 11/1997 Strauss et al. ..... 264/3.1

5,716,557 2/1998 Strauss et al. .

5,717,158 2/1998 Capellos et al. .

5,798,481 8/1998 Manning et al. ..... 149/19.8

5,910,638 6/1999 Spencer et al. ..... 149/18

*Primary Examiner*—Michael J. Carone

*Assistant Examiner*—Aileen J. Baker

*Attorney, Agent, or Firm*—Charles E. Bricker; Thomas L. Kundert

[57] ABSTRACT

The sensitivity to shock initiation of cast 1,3,3-trinitroazetidine (TNAZ) is reduced when an effective amount of at least one nitro-substituted aromatic amine is added to a melt comprising TNAZ.

17 Claims, No Drawings

CASTABLE TNAZ/NITROAROMATICAMINE COMPOSITE EXPLOSIVE

RIGHTS OF THE GOVERNMENT

The invention described herein may be manufactured and used by or for the Government of the United States for all governmental purposes without the payment of any royalty.

BACKGROUND OF THE INVENTION

The invention relates to a method for producing low porosity composite castings of 1,3,3-trinitroazetidine (TNAZ).

1,3,3-Trinitroazetidine (TNAZ) is a high density, high energy explosive compound consisting of a 4-membered azetidine ring, with a geminal dinitro substituent in the 3-position and a nitramine substituent in the 1-position:

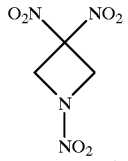

TNAZ has the advantages of (1) a high level of energy release and (2) a stable low melting point of 101° C., making it a melt castable substitute for TNT with double TNT's energy. However, TNAZ has a high vapor pressure and large volume change upon freezing which results in excessive shrinkage and crystal growth upon solidification. Such recrystallization results in significant defects and porosity which result in unacceptable sensitization of cast charges to shock initiation. Porosity is typically 10–12 percent compared with 2–4 percent usually obtained in TNT casting. The porosity of neat-cast TNAZ charges is excessive for use in secondary explosive applications. Sensitivity levels of from 1–4 kbar have been observed in such charges. This is significantly greater than the reported value of 10.4 kbar observed in fine particle size (10 micron) TNAZ recrystallized from ethanol in a crash precipitation process and pressed to high percents (98%) of theoretical maximum density (TMD).

What is desired is a method for casting TNAZ, whereby excessive vapor pressure is suppressed, charge porosity is reduced and crystal growth rates are such that excessive sensitization to shock initiation of cast TNAZ charges does not result.

It is an object of the present invention to provide a method for casting TNAZ, whereby excessive vapor pressure is suppressed, charge porosity is reduced and crystal growth rates are such that excessive sensitization to shock initiation of cast TNAZ charges does not result.

Other objects and advantages of the present invention will be apparent to those skilled in the art.

SUMMARY OF THE INVENTION

In accordance with the present invention there is provided a method for casting TNAZ, whereby excessive vapor pressure is suppressed, charge porosity is reduced and crystal growth rates are such that excessive sensitization to shock initiation of cast TNAZ charges does not result. The method of the present invention comprises the addition of an effective amount of at least one nitro-substituted aromatic amine to a melt comprising TNAZ, such amount being sufficient to provide the desired result. The exact amount required will vary depending on whether and how much of other materials may be added to the melt. An appropriate effective amount may be determined by one of ordinary skill in the art using only routine experimentation. In general, the amount required will be in the approximate range of 5 to 25 percent by weight.

The nitro-substituted aromatic amine may be mono-, di- or tri-nitro or -amino functional or any combination thereof, so long as it contains at least one amino moiety and at least one nitro moiety, such as, for example:

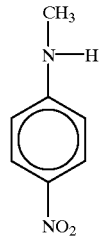

n-methyl-p-nitroaniline (MNA)

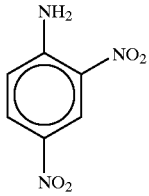

2, 4-dinitroaniline

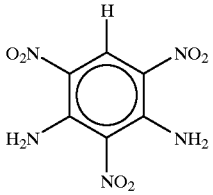

1, 3-diamino-2, 4, 6-trinitro-benzene (DATB).

In accordance with the method of the present invention, the TNAZ is processed by co-melting the TNAZ and the nitro aromatic amine, in an open jacketed melt kettle (75 to 95% by weight TNAZ and 5 to 25% by weight nitro aromatic amine) at a temperature in the approximate range of 75° to 99° C., then cast or poured into a mold or warhead. The item is cooled under controlled conditions (e.g., from bottom to top), upon which the molten composite explosive solidifies. Riser sections may be used to allow some shrinkage to be accommodated. These sections are removed by machining to produce the final finished charge.

The TNAZ/nitro aromatic amine composite may be used either alone or in combination with other conventional solid explosive ingredients, such as RDX (cyclo-1,3,5-trimethylene-2,4,6-trinitramine), HMX (cyclo-1,3,5,7-tetramethylene-2,4,6,8-tetranitramine), ADNBF (7-amino-4,6-dinitrobenzofuroxan), CL-14 (5, 7-diamino-4,6-dinitrobenzofuroxan), CL-20 (2, 4, 6, 8, 10, 12-hexanitro-2, 4, 6, 8, 10, 12-hexaazatetracyclo[5.5.0.0<5,9>0.0<0.3, 11>] dodecane), DINGU (dinitroglycoluril), NTO (3-nitro-1,2,4-triazol-5-one), NQ (nitroguanidine), and similar compounds obvious to those skilled in the art, as the basis for formulating high performance explosive compositions. These other conventional solid explosive ingredients may be added to and dispersed in the molten TNAZ/nitro aromatic amine composite to produce a slurry composite, to modify its performance and sensitivity characteristics for specific applications. Oxidizers such as, but not limited to, ammonium nitrate, ammonium perchlorate, and lithium perchlorate may also be added to and dispersed to alter energy release rates to enhance energy transfer to specific targets. Powered metals such as, but not limited to, aluminum or tungsten may also be added and dispersed to provide altered energy release rates and enhanced blast output as well. Any combination of these ingredients may be used in conjunction to alter the sensitivity and performance properties of the composite for specific applications. Dispersion of such particulate solids in the molten phase is achieved by means of an anchor type mixer blade or side type impeller agitator or combination of both. Typical formulations may contain from about 5 to 90% of the TNAZ/nitro aromatic amine composite, about 0 to 50% conventional solid explosive, about 0 to 50% oxidizer, and about 0 to 30% powdered metal.

The following examples illustrate the invention. The TNAZ was obtained from Gencorp Aerojet, Propulsion Division, Sacramento Calif.; the MNA was obtained from Acros Organics, Pittsburg Pa.

EXAMPLE I

TNAZ/MNA composites containing 80 and 90 weight percent TNAZ, balance MNA, were prepared by co-melting the ingredients in an open jacketed melt kettle. Cylindrical castings (½ by 10 inches) of unmodified TNAZ and the TNAZ/MNA composites were produced by casting molten material at 93° C. into a preheated aluminum split mold. The castings were machined into ½ by 2 inch pellets. The average densities of these pellets are listed in Table I, below.

TABLE I

| Composition | Theoretical Density (TMD), g/cc | Measured Density, g/cc | % TMD |
|---|---|---|---|
| TNAZ | 1.840 | 1.645 | 90.8 |
| TNAZ/MNA 90/10 | 1.747 | 1.655 | 94.7 |
| TNAZ/MNA 80/20 | 1.663 | 1.625 | 97.7 |

EXAMPLE II

Impact Sensitivity

A Bureau of Mines drop hammer, with type 12 tool and 2.5 kg weight was used to determine the impact sensitivity of 35 mg cast pellets (4 mm dia., 2 mm thick). Tests were conducted in accordance with MIL-STD-1751, paragraph 5.51, using the Bruceton up-down method. TNT was used as a standard of comparison. Results are shown in Table II, below.

TABLE II

| Composition | Impact Sensitivity ($H_{50\%}$), cm |
|---|---|
| TNAZ | 21.2 ± 1.2 |
| TNAZ/MNA 90/10 | 38.6 ± 1.4 |
| TNAZ/MNA 80/20 | 34.9 ± 1.4 |
| TNT | 83.6 ± 1.1 |

EXAMPLE III

Friction Sensitivity

Friction sensitivity was evaluated using a Julius Peters K. G., BAM high friction sensitivity tester. The BAM tester employs a fixed porcelain pin and moving porcelain plate that executes a 100 mm reciprocating motion. A torsion arm and weight is used to vary the test load from 0.5 to 36 kg. The relative measure of the friction sensitivity of a material is established as the smallest pin load, in kg, at which ignition does not occur in 8 trials. Result are shown in Table III, below.

TABLE III

| Composition | Friction Sensitivity, kg |
|---|---|
| TNAZ | 16.0 |
| TNAZ/MNA 90/10 | 14.4 |
| TNAZ/MNA 80/20 | 14.4 |
| TNT | 12.8 |

EXAMPLE IV

Insensitive High Explosive Gap Test

In the standard "card gap" test, an explosive donor is set off a certain distance from the explosive. The donor explosive is typically 50/50 pentolite. The space between the donor and the explosive charge is filled with an inert material such as polymethylmethacrylate, PMMA. The distance is expressed in "cards", where 1 card is equal to 0.01 inch.

Tests were conducted in accordance with procedures established by the Naval Surface Weapons Center using a modified Bruceton up-down procedure. This test uses the same boostering system and has a linear correlation with the Naval Ordnance Laboratory Large-Scale Gap Test. Data was interpreted using the calibration obtained from the Naval Ordnance Laboratory. Results are shown in Table IV, below.

TABLE IV

| Composition | Gap Distance, cards | Corresponding pressure, kbar |
|---|---|---|
| TNAZ | 430 to 425 | 4.3 to 4.2 |
| TNAZ/MNA 90/10 | 320 ± 2 | 7.6 ± 0.1 |
| TNAZ/MNA 80/20 | 300 ± 1 | 8.7 ± 0.1 |

Examination of the above data reveals that the shock sensitivity of TNAZ is considerably reduced when compounded with MNA.

The composites of this invention may be used in advanced warhead applications where high rates of energy release are required such as directed, adaptable or deformable warheads for military purposes.

Various modifications may be made to the invention as described without departing from the spirit of the invention or the scope of the appended claims.

We claim:

1. A method for casting 1,3,3-trinitroazetidine (TNAZ) which comprises the addition of an effective amount of at least one nitro-substituted aromatic amine to a melt comprising TNAZ and casting the resulting melt, such amount being sufficient to reduce sensitization to shock initiation of the cast charge.

2. The method of claim 1 wherein said effective amount of said nitro-substituted aromatic amine is about 5 to 25 weight percent.

3. The method of claim 1 wherein said nitro-substituted aromatic amine is n-methyl-p-nitroaniline (MNA).

4. The method of claim 1 further comprising the addition of at least one conventional solid explosive to said TNAZ/nitro aromatic amine melt.

5. The method of claim 1 further comprising the addition of at least one oxidizer to said TNAZ/nitro aromatic amine melt.

6. The method of claim 1 further comprising the addition of at least one powdered metal to said TNAZ/nitro aromatic amine melt.

7. The method of claim 1 further comprising the addition of at least one conventional solid explosive, at least one oxidizer, and at least one powdered metal to said TNAZ/nitro aromatic amine melt.

8. A high density, high energy cast composite explosive comprising 1,3,3-trinitroazetidine (TNAZ) and an effective amount of at least one nitro-substituted aromatic amine.

9. The cast composite explosive of claim 8 wherein the amount of TNAZ is about 75 to 95 percent by weight and the amount of said nitro-substituted aromatic amine is about 5 to 25 percent by weight.

10. The cast composite explosive of claim 9 further comprising at least one conventional solid explosive.

11. The cast composite explosive of claim 9 further comprising at least one oxidizer.

12. The cast composite explosive of claim 9 further comprising at least one powdered metal.

13. The cast composite explosive of claim 9 comprising about 5 to 90 percent of said TNAZ/nitro aromatic amine composite, about 0 to 50% conventional solid explosive, about 0 to 50% oxidizer, and about 0 to 30% powdered metal.

14. The cast composite explosive of claim 8 wherein said nitro-substituted aromatic amine is n-methyl-p-nitroaniline (MNA).

15. The cast composite explosive of claim 9 wherein said nitro-substituted aromatic amine is n-methyl-p-nitroaniline (MNA).

16. The cast composite explosive of claim 15 wherein the amount of said nitro-substituted aromatic amine is 10 weight percent, balance TNAZ.

17. The cast composite explosive of claim 15 wherein the amount of said nitro-substituted aromatic amine is 20 weight percent, balance TNAZ.

* * * * *